US008389070B2

(12) United States Patent
Coulson et al.

(10) Patent No.: US 8,389,070 B2
(45) Date of Patent: Mar. 5, 2013

(54) COATING OF A POLYMER LAYER USING LOW POWER PULSED PLASMA IN A PLASMA CHAMBER OF A LARGE VOLUME

(75) Inventors: Stephen Richard Coulson, Oxford (GB); Ian Burnett, Winscombe (GB); John Henry Sambell, Somerton (GB)

(73) Assignee: The Secretary of State for Defence in Her Britannic Majesty's Government of the United Kingdom of Great Britain and Northern Ireland (GB)

( * ) Notice: Subject to any disclaimer, the term of this patent is extended or adjusted under 35 U.S.C. 154(b) by 1245 days.

(21) Appl. No.: 10/593,207

(22) PCT Filed: Mar. 18, 2005

(86) PCT No.: PCT/GB2005/001017

§ 371 (c)(1), (2), (4) Date: Dec. 6, 2007

(87) PCT Pub. No.: WO2005/089961

PCT Pub. Date: Sep. 29, 2005

(65) Prior Publication Data

US 2008/0260965 A1 Oct. 23, 2008

(30) Foreign Application Priority Data

Mar. 18, 2004 (GB) ..... 0406049.7

(51) Int. Cl.
*H05H 1/24* (2006.01)

(52) U.S. Cl. ..... 427/569; 118/723 R

(58) Field of Classification Search ..... 427/569; 118/723

See application file for complete search history.

(56) References Cited

U.S. PATENT DOCUMENTS

| | | | |
|---|---|---|---|
| 3,102,103 | A | 8/1963 | Albrecht et al. |
| 3,622,893 | A | 11/1971 | Dervieux et al. |
| 4,382,985 | A | 5/1983 | Hattori et al. |

(Continued)

FOREIGN PATENT DOCUMENTS

| | | |
|---|---|---|
| EP | 0049884 | 4/1982 |
| EP | 0403915 | 12/1990 |

(Continued)

OTHER PUBLICATIONS

Lewin, et al., "Handbook of Fibre Science and Technology," Marcel and Dekker, Inc., New York, vol. 2, Part B, Chapter 2, 'Repellent Finishes,' pp. 143-211 (1984).

(Continued)

*Primary Examiner* — Jie Yang

(74) *Attorney, Agent, or Firm* — Dean W. Russell; Tiffany L. Williams; Kilpatrick Townsend & Stockton LLP

(57) ABSTRACT

A method for depositing a polymeric material onto a substrate, said method comprising introducing an organic monomeric material in a gaseous state into a plasma deposition chamber, igniting a glow discharge within said chamber, and applying a high frequency voltage as a pulsed field, at a power of from 0.001 to 500 w/m$^3$ for a sufficient period of time to allow a polymeric layer to form on the surface of the substrate. The method is particularly suitable for producing oil and water repellent coatings, in particular where the monomeric material contains haloalkyl compounds. Apparatus particularly adapted to carry out the method of the invention is also described and claimed.

17 Claims, 2 Drawing Sheets

U.S. PATENT DOCUMENTS

| | | | | |
|---|---|---|---|---|
| 4,532,150 | A | 7/1985 | Endo et al. | |
| 4,585,537 | A | 4/1986 | Nakayama et al. | |
| 4,776,918 | A | 10/1988 | Otsubo et al. | |
| 4,824,753 | A | 4/1989 | Hotomi et al. | |
| 4,827,870 | A * | 5/1989 | Lee | 118/665 |
| 4,938,995 | A | 7/1990 | Giordano et al. | |
| 5,041,304 | A | 8/1991 | Kusano et al. | |
| 5,089,290 | A | 2/1992 | Kleeberg et al. | |
| 5,244,730 | A | 9/1993 | Nguyen et al. | |
| 5,290,378 | A | 3/1994 | Kusano | |
| 5,298,290 | A | 3/1994 | Jost et al. | |
| 5,328,576 | A | 7/1994 | Paskalov et al. | |
| 5,409,777 | A | 4/1995 | Kennedy et al. | |
| 5,622,773 | A | 4/1997 | Reiner et al. | |
| 5,643,638 | A | 7/1997 | Otto et al. | |
| 5,662,773 | A | 9/1997 | Frederick et al. | |
| 5,773,098 | A | 6/1998 | Thomas | |
| 5,876,753 | A | 3/1999 | Timmons et al. | |
| 5,888,591 | A | 3/1999 | Gleason et al. | |
| 6,329,024 | B1 | 12/2001 | Timmons et al. | |
| 6,551,950 | B1 * | 4/2003 | Badyal et al. | 442/79 |
| 6,663,713 | B1 * | 12/2003 | Robles et al. | 118/719 |
| 6,793,728 | B1 | 9/2004 | Davies et al. | |
| 2001/0046146 | A1 | 11/2001 | Batarseh et al. | |

FOREIGN PATENT DOCUMENTS

| | | |
|---|---|---|
| EP | 0896035 | 2/1999 |
| GB | 1106071 | 4/1965 |
| GB | 1102903 | 2/1968 |
| GB | 1530833 | 11/1978 |
| GB | 2105729 | 3/1983 |
| GB | 2108133 | 5/1983 |
| JP | 57119906 | 7/1982 |
| JP | 2061176 | 3/1990 |
| SU | 1158634 | 5/1985 |
| WO | WO 97/13024 | 4/1997 |
| WO | 9738801 | 10/1997 |
| WO | WO 98/58117 | 12/1998 |
| WO | 0228548 | 4/2002 |
| WO | WO 02/094906 | 11/2002 |
| WO | WO 03/090939 | 11/2003 |
| WO | WO 2004/088710 | 10/2004 |

OTHER PUBLICATIONS

Hynes, et al., 'Plasma Polymerization of Trifluoromethyl-Substituted Perfluorocyclohexane Monomers,' *Macromolecules*, 29 :18-21 (1996).

Database WPI, Week 8505, Derwent Publications Ltd. AN 85-027803, XP002079484 & JP 59 222340 A (NIPQ) Dainippon Printing Co. Ltd.), Dec. 14, 1984.

Limb, et al., 'Flexible fluorocarbon wire coatings by pulsed plasma enhanced chemical vapor deposition,' *J. Vac. Sci. Technol.*, A 15(4): 1814-1818 (1997).

Ryan, et al., 'Pulsed Plasma Polymerization of Maleic Anhydride,' *Chem. Mater.*, 8:37-41 (1996).

Wang, et al., "Plasma Synthesis of a Novel $CF_3$-Dominated Fluorocarbon Film," Chem. Mater., 8:2212-2214 (1996).

Yasuda, et al., "Some Aspects of Polymerization, etc.," J. Polymer Science, 15:2411-2425 (1977).

U.S. 55,260 filed Aug. 8, 1997.

U.S. Appl. No. 12/332,750, filed Dec. 11, 2008.

Office Action dated Sep. 4, 2009 in related U.S. Appl. No. 12/332,750.

Response dated Mar. 4, 2010 in related U.S. Appl. No. 12/332,750.

Office Action dated May 6, 2010 in related U.S. Appl. No. 12/332,750.

Response dated Nov. 5, 2010 in related U.S. Appl. No. 12/332,750.

Office Action dated Feb. 7, 2011 in related U.S. Appl. No. 12/332,750.

Response dated Aug. 5, 2011 in related U.S. Appl. No. 12/332,750.

Office Action dated Sep. 14, 2011 in related U.S. Appl. No. 12/332,750.

Notice of Abandonment dated Mar. 27, 2012 in U.S. Appl. No. 12/332,750.

Response dated Aug. 3, 2010 in related Application No. EP 05007277.6-2124.

U.S. Appl. No. 11/113,340, filed Apr. 22, 2005.

Office Action dated Jun. 20, 2007 in related U.S. Appl. No. 11/113,340.

Response dated Nov. 19, 2007 in related U.S. Appl. No. 11/113,340.

Office Action dated Dec. 11, 2007 in related U.S. Appl. No. 11/113,340.

Response dated Mar. 10, 2008 in related U.S. Appl. No. 11/113,340.

Advisory Action dated Mar. 31, 2008 in related U.S. Appl. No. 11/113,340.

Response dated Apr. 11, 2008 in related U.S. Appl. No. 11/113,340.

Office Action dated Apr. 18, 2008 in related U.S. Appl. No. 11/113,340.

Response dated Jul. 3, 2008 in related U.S. Appl. No. 11/113,340.

Office Action dated Sep. 11, 2008 in related U.S. Appl. No. 11/113,340.

Response dated Dec. 11, 2008 in related U.S. Appl. No. 11/113,340.

Advisory Action dated Dec. 31, 2008 in related U.S. Appl. No. 11/113,340.

Response dated Feb. 2, 2009 in related U.S. Appl. No. 11/113,340.

Office Action dated Jun. 30, 2009 in related U.S. Appl. No. 11/113,340.

Response dated Dec. 22, 2009 in related U.S. Appl. No. 11/113,340.

Office Action dated Jan. 26, 2010 in related U.S. Appl. No. 11/113,340.

Response dated Jul. 26, 2010 in related U.S. Appl. No. 11/113,340.

Office Action dated Aug. 6, 2010 in related U.S. Appl. No. 11/113,340.

Response dated Jan. 6, 2011 in related U.S. Appl. No. 11/113,340.

Office Action dated Feb. 1, 2011 in related U.S. Appl. No. 11/113,340.

Response dated Aug. 1, 2011 in related U.S. Appl. No. 11/113,340.

Office Action dated Sep. 16, 2011 in related U.S. Appl. No. 11/113,340.

Response dated Mar. 12, 2012 in related U.S. Appl. No. 11/113,340.

* cited by examiner

COATING OF A POLYMER LAYER USING LOW POWER PULSED PLASMA IN A PLASMA CHAMBER OF A LARGE VOLUME

Cross Reference to Related Applications

This application is the U.S. national phase of International Application No. PCT/GB2005/001017 filed on Mar. 18, 2005 published in English on Sep. 29, 2005 as International Publication No. WO 2005/089961 A1, which application claims priority to Great Britain Application No. 0406049.7 filed on Mar. 18, 2004, the contents of which are incorporated by reference herein.

The present invention relates to the coating of surfaces, in particular to the production of oil- and water-repellent surfaces, as well as to coated articles obtained thereby.

Oil- and water-repellent treatments for a wide variety of surfaces are in widespread use. For example, it may be desirable to impart such properties to solid surfaces, such as metal, glass, ceramics, paper, polymers etc. in order to improve preservation properties, or to prevent or inhibit soiling.

A particular substrate which requires such coatings are fabrics, in particular for outdoor clothing applications, sportswear, leisurewear and in military applications. Their treatments generally require the incorporation of a fluoropolymer into or more particularly, fixed onto the surface of the clothing fabric. The degree of oil and water repellency is a function of the number and length of fluorocarbon groups or moieties that can be fitted into the available space. The greater the concentration of such moieties, the greater the repellency of the finish.

In addition however, the polymeric compounds must be able to form durable bonds with the substrate. Oil- and water-repellent textile treatments are generally based on fluoropolymers that are applied to fabric in the form of an aqueous emulsion. The fabric remains breathable and permeable to air since the treatment simply coats the fibres with a very thin, liquid-repellent film. In order to make these finishes durable, they are sometimes co-applied with cross-linking resins that bind the fluoropolymer treatment to fibres. Whilst good levels of durability towards laundering and dry-cleaning can be achieved in this way, the cross-linking resins can seriously damage cellulosic fibres and reduce the mechanical strength of the material. Chemical methods for producing oil- and water-repellent textiles are disclosed for example in WO 97/13024 and British patent No 1,102,903 or M. Lewin et al., 'Handbook of Fibre Science and Technology' Marcel and Dekker Inc., New York, (1984) Vol 2, Part B Chapter 2.

Plasma deposition techniques have been quite widely used for the deposition of polymeric coatings onto a range of surfaces. This technique is recognised as being a clean, dry technique that generates little waste compared to conventional wet chemical methods. Using this method, plasmas are generated from organic molecules, which are subjected to an electrical field. When this is done in the presence of a substrate, the radicals and molecules of the compound in the plasma polymerise in the gas phase and react with a growing polymer film on the substrate. Conventional polymer synthesis tends to produce structures containing repeat units which bear a strong resemblance to the monomer species, whereas a polymer network generated using a plasma can be extremely complex.

WO98/58117 describes the formation of oil or water repellent coatings on a surface using monomeric unsaturated organic compounds, and in particular unsaturated halocarbons, which are polymerised on the surface using a plasma deposition process. This process produces good oil and water repellent coatings, and this is illustrated using small-scale units of 470 $cm^3$.

For most commercial applications much larger scale production units are required. However, initial trials revealed that replication of the conditions used in the small-scale unit in larger chambers did not produce satisfactory results.

According to the present invention, there is provided a method for depositing a polymeric material onto a substrate, said method comprising introducing an monomeric material in a gaseous state into a plasma deposition chamber, igniting a glow discharge within said chamber, and applying a voltage as a pulsed field, at a power of from 0.001 to 500 $w/m^3$ for a sufficient period of time to allow a polymeric layer to form on the surface of the substrate.

As used herein, the expression "in a gaseous state" refers to gases or vapours, either alone or in mixture, as well as aerosols.

These conditions are particularly suitable for depositing good quality oil and water repellent surfaces of uniform thickness, in large chambers, for example in chambers where the plasma zone has a volume of greater than 500 $cm^3$, for instance 0.5 $m^3$ or more, such as from 0.5 $m^3$-10 $m^3$ and suitably at about 1 $m^3$. The layers formed in this way have good mechanical strength and remain substantially in place, through a conventional washing process.

The power levels, and particularly the power densities, that give the best results are lower than those conventionally used in this type of process. This is quite unexpected. In particular the power is applied at from 0.001 to 100 $w/m^3$, suitably from 0.01 to 10 $w/m^3$.

The dimensions of the chamber will be selected so as to accommodate the particular substrate being treated, but in general will be of a reasonably large size, to accommodate plasma zones having the volumes described above. For instance, generally cuboid chambers may be suitable for a wide range of applications, but if necessary, elongate or rectangular chambers may be constructed, for example where the substrates are generally of this profile, such as wood, rolls of fabric etc. Sheet materials can be processed using a "roll to roll" arrangement.

The chamber may be a sealable container, to allow for batch processes, or it may comprise inlets and outlets for substrates, to allow it to be utilised in a continuous process. In particular in the latter case, the pressure conditions necessary for creating a plasma discharge within the chamber are maintained using high volume pumps, as is conventional for example in a device with a "whistling leak".

In particular, the monomeric material is a material as described in WO98/58117. Specifically, it comprises an organic compound, which comprises a chain of carbon atoms, at least some of which are preferably substituted by halogen.

In particular, the compounds are unsaturated and so contain at least one double bond or triple bond that is capable of reacting to form a polymeric compound. Preferably the compounds contain at least one double bond.

By "chain" is meant that the carbon atoms form straight or branched chains. Suitably, the chains are not cyclic. The compounds used in the method of the invention include at least one such chain. Suitable chains have from 3 to 20 carbon atoms, more suitably from 6 to 12 carbon atoms Monomeric compounds used in the method may include a double or triple bond within a chain and so comprise an alkene or alkyne respectively. Alternatively, the compounds may comprise an alkyl chain, optionally substituted by halogen, as a substituent which is attached to an unsaturated moiety either directly or by way of an functional group, such as a ester or sulphonamide group.

As used therein the term "halo" or "halogen" refers to fluorine, chlorine, bromine and iodine. Particularly preferred halo groups are fluoro. The term "aryl" refers to aromatic cyclic groups such as phenyl or napthyl, in particular phenyl. The term "alkyl" refers to straight or branched chains of carbon atoms, suitably of up to 20 carbon atoms in length. The term "alkenyl" refers to straight or branched unsaturated chains suitably having from 2 to 20 carbon atoms.

Monomeric compounds where the chains comprise unsubstituted alkyl or alkenyl groups are suitable for producing coatings which are water repellent. By substituting at least some of the hydrogen atoms in these chains these chains with at least some halogen atoms, oil repellency may also be conferred by the coating.

Thus in a preferred aspect, the monomeric compounds include haloalkyl moieties or comprise haloalkenyls. Therefore, preferably the plasma used in the method of the invention will comprise a monomeric unsaturated haloalkyl containing organic compound.

Examples of monomeric organic compounds for use in the process of the invention are compounds of formula (I)

(I)

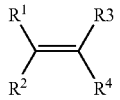

where $R^1$, $R^2$ and $R^3$ are independently selected from hydrogen, alkyl, haloalkyl or aryl optionally substituted by halo; provided that at least one of $R^1$, $R^2$ or $R^3$ is hydrogen, and $R^4$ is a group X—$R^5$ where $R^5$ is an alkyl or haloalkyl group and X is a bond; a group of formula —$C(O)O(CH_2)_nY$— where n is an integer of from 1 to 10 and Y is a bond or a sulphonamide group; or a group —$(O)_pR^6(O)_q(CH_2)_t$— where $R^6$ is aryl optionally substituted by halo, p is 0 or 1, q is 0 or 1 and t is 0 or an integer of from 1 to 10, provided that where q is 1, t is other than 0.

Suitable haloalkyl groups for $R^1$, $R^2$, $R^3$ and $R^5$ are fluoroalkyl groups. The alkyl chains may be straight or branched and may include cyclic moieties.

For $R^5$, the alkyl chains suitably comprise 2 or more carbon atoms, suitably from 2-20 carbon atoms and preferably from 6 to 12 carbon atoms.

For $R^1$, $R^2$ and $R^3$, alkyl chains are generally preferred to have from 1 to 6 carbon atoms.

Preferably $R^5$ is a haloalkyl, and more preferably a perhaloalkyl group, particularly a perfluoroalkyl group of formula $C_mF_{2m+1}$ where m is an integer of 1 or more, suitably from 1-20, and preferably from 6-12 such as 8 or 10.

Suitable alkyl groups for $R^1$, $R^2$ and $R^3$ have from 1 to 6 carbon atoms.

Preferably however, at least one of $R^1$, $R^2$ and $R^3$ is hydrogen and preferably $R^1$, $R^2$, $R^3$ are all hydrogen.

Where X is a group —$C(O)O(CH_2)_nY$—, n is an integer which provides a suitable spacer group. In particular, n is from 1 to 5, preferably about 2.

Suitable sulphonamide groups for Y include those of formula —$N(R^7)SO_2$— where $R^7$ is hydrogen or alkyl such as $C_{1-4}$alkyl, in particular methyl or ethyl.

In one embodiment, the compound of formula (I) is a compound of formula (II)

$$CH_2{=}CH{-}R^5 \quad \text{(II)}$$

where $R^5$ is as defined above in relation to formula (I).

In compounds of formula (II), X in formula (I) is a bond.

However in a preferred embodiment, the compound of formula (I) is an acrylate of formula (III)

$$CH_2{=}CR^7C(O)O(CH_2)_nR^5 \quad \text{(III)}$$

where n and $R^5$ as defined above in relation to formula (I) and $R^7$ is hydrogen, $C_{1-110}$ alkyl, or $C_{1-10}$haloalkyl. In particular $R^7$ is hydrogen or $C_{1-6}$alkyl such as methyl. A particular example of a compound of formula (III) is a compound of formula (IV)

(IV)

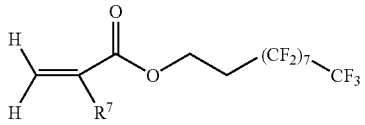

where $R^7$ is as defined above, and in particular is hydrogen and x is an integer of from 1 to 9, for instance from 4 to 9, and preferably 7. In that case, the compound of formula (IV) is 1H,1H,2H,2H-heptadecafluorodecylacylate.

Using these compounds in the process of the invention, coatings with good water hydrophobicity and oleophobicity values are achieved. These properties can be tested using "3M Test Methods" such as the 3M oil repellency Test 1, (3M Test Methods Oct. 1, 1988) and a water repellency test, (the 3M water repellency Test II, water/alcohol drop test, 3M Test 1, 3M Test Methods, Oct. 1, 1998). These tests are designed to detect a fluorochemical finish on all types of fabrics by measuring:

(a) aqueous stain resistance using mixture of water and isopropyl alcohol.

(b) the fabric's resistance to wetting by a selected series of hydrocarbon liquids of different surface tensions.

These tests are not intended to give an absolute measure of the fabric's resistance to staining by watery or oily materials, since other factors such as fabric construction, fibre type, dyes, other finishing agents, etc., also influence stain resistance. These tests can, however, be used to compare various finishes. The water repellency tests comprises placing 3 drops of a standard test liquid consisting of specified proportions of water and isopropyl alcohol by volume onto the plasma polymerised surface. The surface is considered to repel this liquid if after 10 seconds, 2 of the 3 drops do not wet the fabric. From this, the water repellency rating is taken as being the test liquid with the greater proportion of isopropyl alcohol which passes the test. In the case of the oil repellency test, 3 drops of hydrocarbon liquid are placed on the coated surface. If after 30 seconds no penetration or wetting of the fabric at the liquid-fabric interface occurs and no wicking around 2 of the 3 drops is evident, then the test is passed.

The oil repellency rating is taken to be the highest-numbered test liquid which does not wet the fabric surface (where the increasing number corresponds to decreasing hydrocarbon chain and surface tension).

The results obtained using these tests are variable depending upon the nature of the substrate, and in particular the roughness of the substrate, but certain products obtained using the method of the invention have achieved water hydrophobicity values of up to 10 and oleophobicity values of 8 by means of large scale production. In fact, some coated materials has shown repellency to heptane and pentane, which represents a degree of oleophobicity which is off the normal 3M scale.

Other compounds of formula (I) are styrene derivatives as are well known in the art of polymerisation.

Suitable plasmas for use in the method of the invention include non-equilibrium plasmas such as those generated by radiofrequencies (Rf), microwaves or direct current (DC). They may operate at atmospheric or sub-atmospheric pressures as are known in the art. In particular however, they are generated by radiofrequencies (Rf).

The gas supplied to the plasma chamber may comprise a vapour of the monomeric compound alone, but preferably, it is combined with a carrier gas, in particular, an inert gas such as helium or argon. In particular helium is a preferred carrier gas as this minimises fragmentation of the monomer.

The ratio of the monomeric gas to the carrier gas is suitably in the range of from 100:1 to 1:100, for instance in the range of from 10:1 to 1:100, and in particular about 1:1 to 1:10, such as at about 1:5. This helps to achieve the high flow rates required by the process of the invention. Suitably the gas or gas mixture is supplied at a rate of at least 1 standard cubic centimeter per minute (sccm) and preferably in the range of from 1 to 1000 sccm.

Gases are suitably drawn into the chamber as a result of a reduction in the pressure within the chamber as a result of a evacuating pump, or they may be pumped into the chamber.

Polymerisation is suitably effected using vapours of compounds of formula (I) in the chamber, which are maintained at pressures of from 0.01 to 300 mbar, suitably at about 80-100 mbar.

A glow discharge is then ignited by applying a high frequency voltage, for example at 13.56 MHz. This is suitably applied using electrodes, which may be internal or external to the chamber, but in the case of the larger chambers are preferably internal.

The applied fields are suitably of power of up to 500 W, suitably at about 40 W, applied as a pulsed field. The pulses are applied in a sequence which yields very low average powers, for example in a sequence in which the ratio of the time on:time off is in the range of from 1:500 to 1:1000. Particular examples of such sequence are sequences where power is on for 20 μs and off for from 1000 μs to 20000 μs. Typical average powers obtained in this way are 0.04 W.

The fields are suitably applied from 30 seconds to 90 minutes, preferably from 5 to 60 minutes, depending upon the nature of the compound of formula (I) and the substrate etc.

Plasma polymerisation of compounds of formula (I), particularly at average powers much lower than previously used, has been found to result in the deposition of highly fluorinated coatings which exhibit high levels of hydrophobicity and oleophobicity, even when produced on a large scale. In addition, a high level of structural retention of the compound of formula (I) occurs in the coating layer, which may be attributed to the direct polymerisation of the alkene monomer for instance a fluoroalkene monomer via its highly susceptible double bond.

It has been noted, particularly in the case of the polymerisation of compounds of formula (III) above, that low power pulsed plasma polymerisation produces well-adhered coatings which exhibit excellent water and oil repellency. Furthermore, the coatings are of a good uniform thickness.

The greater level of structural retention can be attributed to free radical polymerisation occurring during the duty cycle off-time and less fragmentation during the on-time.

The gas is suitably supplied to the chamber by way of a temperature gradient. For example, gas is pumped along a heated pipe leading from a gas supply to the plasma chamber. The pipe is suitably heated such that the temperature of gas entering the chamber is from 30 to 60° C., depending upon the nature of the monomer used. In particular, the temperature of the gas entering the chamber is higher, preferably about 10° C. higher, than the gas leaving the supply. The supply is suitably kept at ambient temperature, or slightly elevated temperature such as 30° C., again depending upon the nature of the monomer involved.

Using heating of the supply pipes and chamber in this way, the applicants have found that the monomer vapour is transported efficiently into the chamber, and once in the chamber, remains mobile. This leads to efficient deposition and polymerisation of monomer, and minimises any condensation of gas, which may occur in "cold spots" of the pipework. Although heating of the chamber has been used previously in plasma etching processes in order to keep etch products mobile, so that they can be evacuated from the chamber, such a process is not required in the present instance, and therefore it is unexpected that heating is preferred.

Novel apparatus for use in the method described above, form a further aspect of the invention. Specifically, the apparatus comprises a plasma deposition chamber, a pumping system arranged to feed monomer in gaseous form into the chamber, at least two electrodes arranged so as to ignite a plasma within the chamber, and power control means programmed to pulse power supplied to the electrodes so as to produce a plasma at a power of from 0.001 to 500 w/m$^3$ within a plasma zone within the chamber.

The pumping system is suitably one which can supply large amounts of vapours into the chamber, and to ensure that this remains in the chamber for the minimum adequate residence time, to achieve the desired effect. It may comprise a series of pumps, and large conductance pipes. The pumping system may also be arranged to draw gas out of the chamber to evacuate air, and/or reduce the pressure, as required.

In a particular embodiment, the pumping system comprises two pumps. A first pump or roots pump, which is suitably a high volume pump, is arranged to evacuate any vapours including water vapour or other contaminants from the chamber. In order to do this efficiently, and in a reasonable timeframe, bearing in mind the size of the chamber, the pump is suitably arranged close to the chamber, and connected to it by way of a single straight pipe, with as large a diameter as possible. A valve is provided in the pipe so that once the chamber has been evacuated, it can be sealed.

A second pump is suitably a lower volume pump, such as a dry rotary pump. This is suitably connected to the chamber by the same opening as the first pump. It is arranged so that it can draw monomer, together with any carrier gas into the chamber at a suitable rate, and maintain the desired pressure and residence time of gas within the chamber.

The pumping means suitably vents to a furnace where any remaining monomer or fragments therefore, are incinerated before the gases safely pass into the atmosphere.

Preferably the apparatus further comprises heating means for the chamber. These may be integral with the walls of a chamber, or present in a casing surrounding the chamber. They may comprise electrical elements or recirculated, heated oil filled elements, suitably under the control of a temperature controller, to ensure that the desired temperature is maintained within the chamber.

Preferably also the apparatus comprises a container for monomer, which is connected to the chamber by a suitable pipe and valve arrangement. Preferably, this container is provided with a heater, which will allow the monomer to be heated above ambient temperature, if required, before being introduced into the chamber. Preferably the container, the pipe leading from it to the chamber and the chamber itself are all heated, and the heating means are arranged to produce an increasing temperature gradient along the path of the monomer.

A supply of carrier gas may, if required, be connected to the container and gas from this supply can be passed into the container if required, in order to produce a sufficient flow of gas into the chamber to produce the desired result.

In use, in a batch process, the items to be coated are introduced into the chamber. In a particular embodiment, these are ready made garments, to which a water and/or oil repellent coating is to be applied. By depositing the polymer to the finished garment, rather than to the fabric used in the production, an "all over" coating is achieved, including areas such as zips, fasteners or stitched joints, which would otherwise remain uncoated.

The chamber is then evacuated, for instance using the entire pump suite, but in particular the large roots pump where provided. Once the chamber is evacuated, monomer vapour, which is suitably warmed, is fed into it from the container. This is achieved for instance, by drawing using a second pump from a container in which a supply of liquid monomer is held. This container is suitably heated to a temperature sufficient to cause vaporization of the monomer.

Preferably also the pipes and conduits which lead from the container to the chamber are also heatable. This means that it is possible to ensure that monomer is not lost through condensation in the feed pipes.

If desired, a carrier gas, which may be an inert gas such as argon or helium, and preferably helium may be fed through the chamber in order to provide a sufficient gas flow to achieve the desired concentrations and volume homogeneity of monomer in the chamber.

Alternatively, monomer vapour may be drawn from the container and subsequently mixed with the carrier gas. Preferably prior to mixing, the monomer vapour is passed through a liquid/vapour flow controller. This arrangement allows more controllable mixing to achieve the desired ratio of carrier gas:monomer. In addition, the environment of the monomer, and in particular the temperature, may be controlled independently of the flow requirements. Furthermore, reactive monomers may suitably be stored in the container under an inert atmosphere for example, a nitrogen atmosphere. Suitably the container may be pressurised, so that the nitrogen is above atmospheric pressure, so as to assist the flow of monomer vapour from the container into the chamber, which is at lower pressure.

A glow discharge is then ignited within the chamber for instance by applying a voltage such as a high frequency voltage, for example at 13.56 MHz. Thereafter, the power is pulsed as described above, so as to produce a low average power. As a result, a monomer becomes activated and attaches to the surface of the substrate, whereupon it builds up a polymeric layer. At the low powers used in the method of the invention, unsaturated monomers form uniform layers of high structural integrity. The effect of this depends upon the nature of the monomer being used, but the specific examples provided above can give excellent hydrophobicity and/or oleophobicity.

The invention will now be particularly described by way of example with reference to the accompanying diagrammatic drawings in which.

Figure 1:
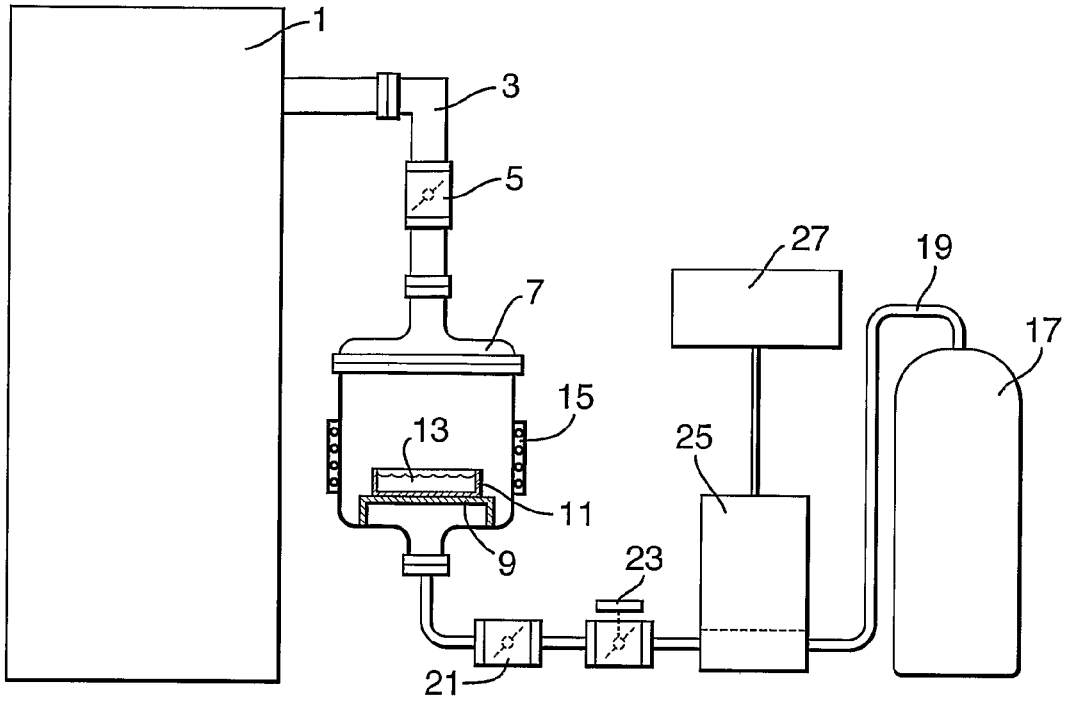
FIG. 1 is a diagrammatic representation of a monomer supply system which can be used in an embodiment of the invention.

The apparatus illustrated in FIG. 1 shows a process system containing a plasma chamber (1). Recirculated heated oil filled heating elements are incorporated into outer walls of the plasma chamber (1). The temperature within the chamber is measurable by a thermocouple (not shown), and this information feeds to the controls for the heater, so that the required temperature can be maintained within the plasma chamber (1). Also within the plasma chamber, a pair of facing electrodes are provided, which define between them a plasma zone of approximately 1 $m^3$. The electrodes are connected to a suitable power supply which is controllable and programmable.

A monomer delivery pipe (3) which incorporates a valve (5) feeds into the plasma chamber (1). A sealable chamber (7) for monomer is provided at the end of the pipe (3). Within the chamber (7) is arranged a support (9) on which an open container (11) for monomer (13) can be positioned. The chamber (7) is provided with a controllable heater, for instance a band heater (15), extending around the chamber (7).

In addition, a supply of inert gas (17), such as argon or helium, is connected to the chamber (7) by means of a pipe (19) in which are provided a valve (21) and a manual valve (23) together with a mass flow controller (25). The gas supply is controllable and can be observed by means of a display (27).

Figure 2:
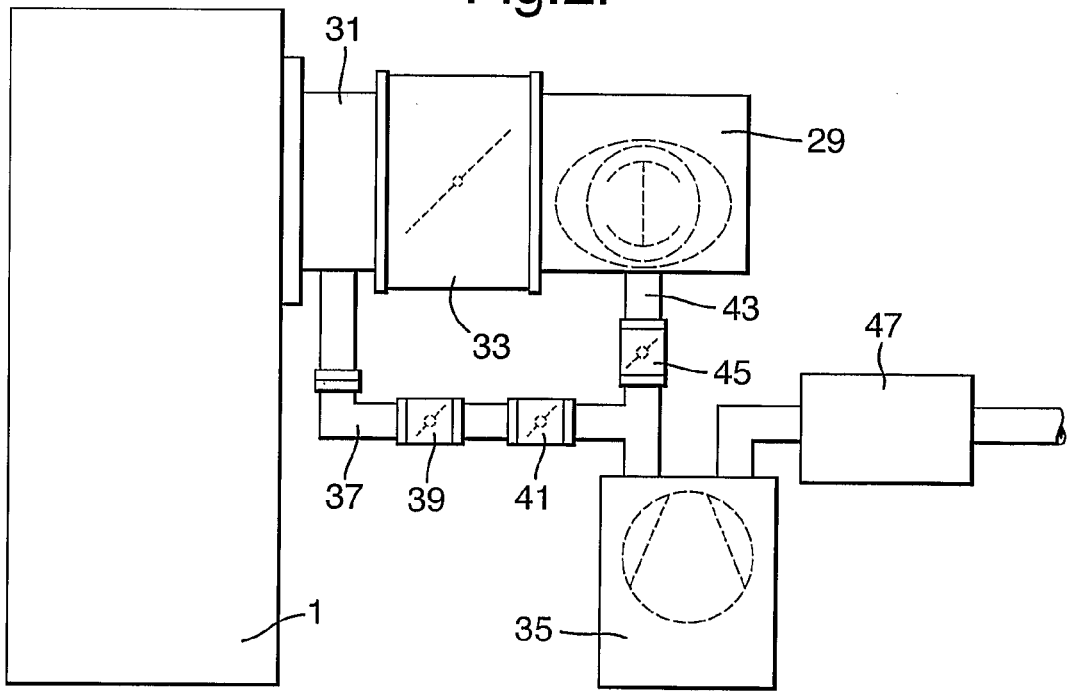
FIG. 2 is a diagrammatic representation of a pumping system which can be used in an embodiment of the invention.

The plasma chamber (1) is provided with a pump arrangement illustrated diagrammatically in FIG. 2. This comprises a roots and rotary pump combination, arranged to evacuate the chamber. A roots pump (29) is connected to the plasma chamber by means of a pipe (31) which is preferably straight and which has as large a diameter as possible. In this case the diameter of the pipe is 160 mm. By ensuring that there are no bends in the pipe (31), the conductance loss can be minimised. An isolation valve (33) is provided in the pipe (31) so as to isolate the pump (29) from the plasma chamber.

A low volume rotary pump (35) is also provided and is connectable to the pipe (31) downstream of the valve (33), by means of a smaller pipe (37), for instance of 63 mm diameter, provided with an automatic pressure control (APC) valve (39) and an isolation valve (41). A flexible by-pass pipe (43), which is also provided with a valve (45), connects the roots pump (29) directly to the rotary pump (35).

Finally, a furnace (47) is provided downstream of the rotary pump (35), which is provided so as to incinerate any gases venting out of the system.

The combination of roots and rotary pump illustrated provides an overall pumping speed of the order of 350 $m^3$/hour, which allows for rapid pumpdown of the plasma chamber.

Figure 3:
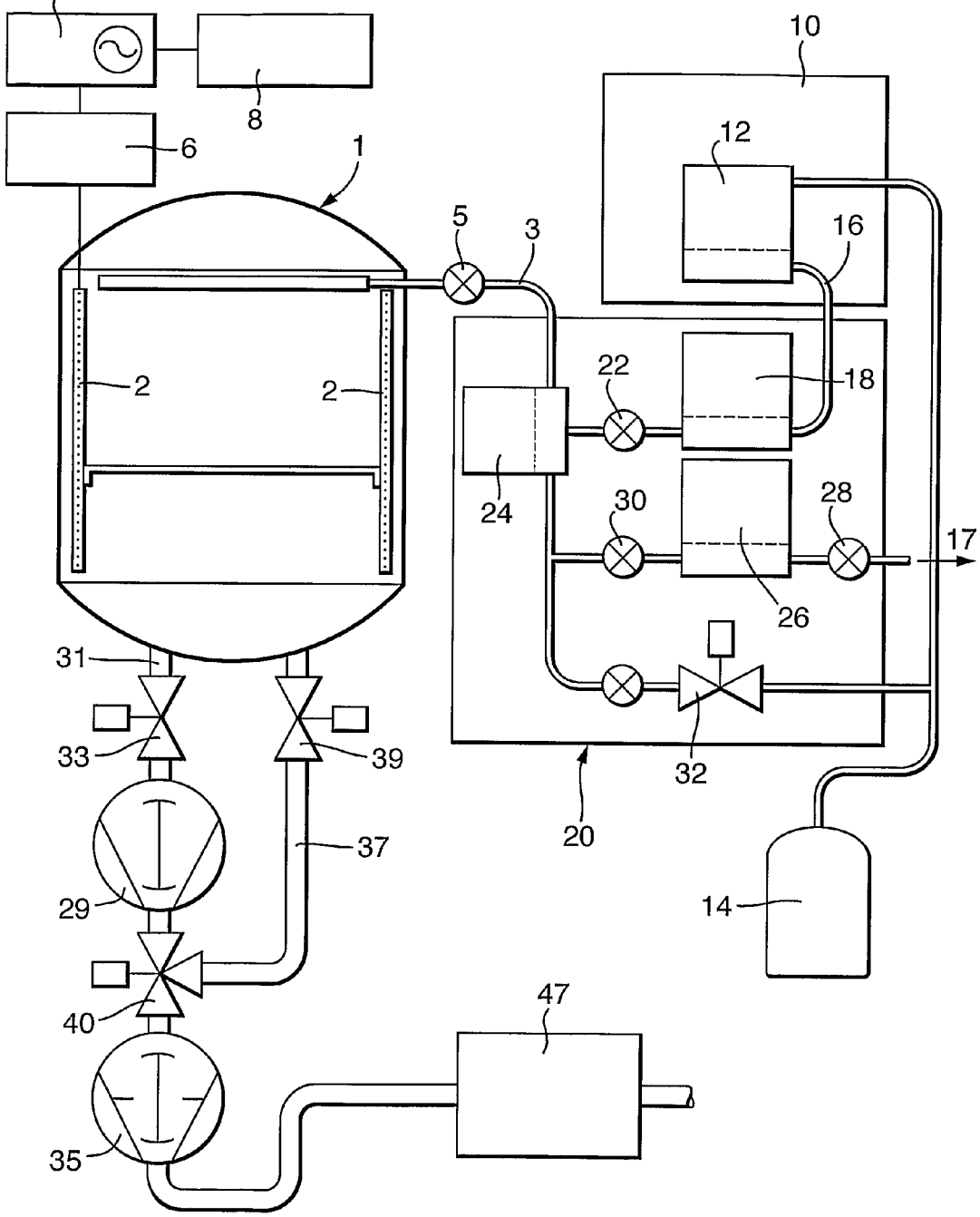
FIG. 3 is a diagrammatic representation of alternative apparatus which can be used in an embodiment of the invention.

An alternative arrangement is illustrated in FIG. 3. In this illustration, the electrodes (2) within the chamber (1) are shown. These are electrically connected to an RF generator (4), by way of an RF matching unit (6). The RF generator (4) is controlled by a function generator (8) which is set to produce pulses in the RF field as described above. The RF matching unit ensures that the pulsing within the chamber (1) is in line with that produced within the generator (4).

In this instance, the pump system is slightly different in that the roots pump (29) and rotary pump (35) are interconnected by a single 3-way process/roughing selector valve (40) that replaces the valves 41 and 45 of the FIG. 2 embodiment. The pipe (37) containing the process pressure control valve 39 also connects to this valve. As a result, the combination roots and rotary pump can be used to draw gases through the process chamber (1) and vent them to the furnace (47) in a broadly similar manner to that described above in relation to FIGS. 1 and 2. Rapid evacuation of gas from within the chamber can be carried out by opening valves 33 and 40 and operating the pump (29) and, if required, also the pump (35). However, the roots pump (29) can be isolated from the system by closure of valves (33) and adjustment of valve (40), and more controlled flow of gas through the chamber induced by the use of pump (35), which draws gas through pipe (37) when valve (39) is open.

In this apparatus also, the monomer feed arrangement is also modified to make it more controllable. Specifically, a separate monomer handling unit (10) is provided. This comprises a monomer reservoir (12), in which monomer can be kept under controlled environment conditions. For instance, the monomer can be kept in the dark, under an atmosphere of inert gas such as nitrogen, which is supplied from a suitable gas supply (14). These conditions minimise the chances that the monomer will prematurely polymerise.

Monomer is able to feed out of the reservoir (12) through a pipe (16) leading downwards from the monomer container (11) (not shown in this instance). This flow may be assisted by maintaining the pressure of inert gas within the reservoir at something above atmospheric pressure so as to create a pressure differential. A nitrogen bleed valve (32) is also provided in the system.

The pipe (16) suitably carries monomer into a liquid/vapour flow controller (18) which is contained within a temperature controlled gas unit (20). The temperature within the controller (18) is monitored and controlled to ensure that any condensed monomer is evaporated, and the vapour at the required concentration leaves the controller via a valve (22), where it enters a gas injector unit (24).

Within that unit, the monomer vapour is mixed with the required amount of carrier gas, such as helium, which is fed into the injector unit (24) from a suitable supply (17) by way of a helium mass flow controller (26). Valves (28, 30) can be used to isolate the helium supply (17) if required. The temperature of the controller (26) can be independently controlled so that gas at the appropriate pressure to achieve the desired mixture is supplied to the injector unit (24). Mixtures produced in the injector unit (24) are fed into the chamber (1) via pipe (3) which is closable by valve (5) in a similar manner to that described in relation to FIG. 1.

EXAMPLE 1

A pillowcase was suspended within a plasma chamber of the apparatus of FIG. 1 and FIG. 2, between the electrodes and therefore within the plasma zone. In addition a sample of 1H,1H,2H,2H-heptadecafluorodecylacylate (10 g) was placed into the container (11) within the monomer chamber (7). At this time the valves 5, 21, 23 and 33 are closed.

The plasma chamber was then rapidly (within 5 minutes) evacuated to a pressure of $2\times10^{-3}$ bar by opening valves 33 and 45, and operating the pumps 29, 35 to draw air out of the chamber. The rotary pump 35 was then isolated from the system by closing the valves 33 and 45.

The plasma chamber was then heated by the heater in the walls of the process chamber (1) and a temperature of between 40-50° C., in particular 50° C. was maintained.

Similarly the band heater 15 was operated to heat the monomer chamber 7 to a temperature of 45° C., and to maintain it at that temperature.

Valves 39 and 41 were then opened, as were valves 21 and 23, and helium gas from the supply (17) was drawn into the chamber (7) by the operation of the rotary pump 35 at a rate of 60 sccm. In passing over the monomer, the helium gas acted as a carrier to take monomer vapour into the plasma chamber.

After a period of 2 minutes, during which any remaining air was purged from the system, the desired pressure was reached within the chamber, and an RF plasma was ignited between the electrodes. The power supply was pulsed such that the power was on for 20 μs and off for 20000 μs.

Gases drawn through the plasma chamber were passed out through pipe 37 and pump 35, and into the furnace 47, which was held at 300° C.

After 30 minutes, the valves 39 and 41 were closed to isolate the pump 35, and the system was vented with dry nitrogen. The pillowcase was removed, the oil and water repellency tested using 3M oil repellency Test I, (3M Test Methods Oct. 1, 1988) and a water repellency test, (the 3M water repellency Test II, water/alcohol drop test, 3M Test 1, 3M Test Methods, Oct. 1, 1998). The results, even after washing in a conventional washing machine, were water hydrophobicity values of 10 and oleophobicity values of 8.

In contrast, a pillowcase treated under similar conditions but with 200 watts of RF power at 13.56 M Hz applied continuously produced a coating which was easily rubbed off.

The invention claimed is:

1. A method for depositing a polymeric material onto a substrate, the method comprising introducing a monomeric material in a gaseous state into a plasma deposition chamber in which a plasma zone has a volume of at least 0.5 $m^3$, igniting a glow discharge within said chamber, and applying a voltage as a pulsed field, at a power of from 0.001 to 500 $w/m^3$ for a sufficient period of time to allow a polymeric layer to form on the surface of the substrate.

2. The method of claim 1 wherein the plasma zone within the chamber has a volume of about 1 $m^3$ or more.

3. The method of claim 2 wherein the plasma zone has a volume of between 1 $m^3$ and 10 $m^3$.

4. The method of claim 1 wherein the power is applied at from 0.001 to 100 $w/m^3$.

5. The method of claim 4 wherein the power is applied at from 0.04 to 100 $w/m^3$.

6. The method of claim 1 wherein the monomeric material is an unsaturated organic compound comprising a chain of carbon atoms, which are optionally substituted by halogen.

7. The method of claim 6 wherein the monomeric material is a compound of formula (I):

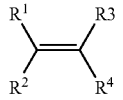

(I)

where $R^1$, $R^2$ and $R^3$ are independently selected from hydrogen, alkyl, haloalkyl or aryl optionally substituted by halo; provided that at least one of $R^1$, $R^2$ or $R^3$ is hydrogen, and $R^4$ is a group X—$R^5$ where $R^5$ is an alkyl or haloalkyl group and X is a bond; a group of formula —$C(O)O(CH_2)_nY$— where n is an integer of from 1 to 10 and Y is a bond or a sulphonamide group; or a group —$(O)_pR^6(O)_q(CH_2)_t$— where $R^6$ is aryl optionally substituted by halo, p is 0 or 1, q is 0 or 1 and t is 0 or an integer of from 1 to 10, provided that where q is 1, t is other than 0.

8. The method of claim 7 wherein the compound of formula (I) is an acrylate of formula (III)

$$CH_2{=}CR^7C(O)O(CH_2)_nR^5 \quad \text{(III)}$$

where n and $R^5$ as defined above in claim 7 and $R^7$ is hydrogen or $C_{1-6}$ alkyl.

9. The method of claim 8 wherein the acrylate of formula (III) is 1H,1H,2H,3H-heptadecafluorodecylacylate.

10. The method of claim 1 wherein the monomeric compound in a gaseous state is supplied to the chamber in combination with a carrier gas.

11. The method of claim 10 wherein the carrier gas is helium.

12. The method of claim 10 wherein the ratio of the monomeric compound in a gaseous state to the carrier gas is from 100:1 to 1:100.

13. The method of claim 1 wherein gaseous material is supplied to the chamber at a rate of at least 1 standard cubic centimeter per minute (sccm).

14. The method of claim 1 wherein vapours of compounds of formula (I) in the chamber are maintained at pressures of from 0.01 to 300 mbar.

15. The method of claim 1 wherein the power is pulsed in a sequence in which the power is on for 20 μs and off for from 1000 μs to 20000 μs.

16. The method of claim 1 wherein gas is supplied to the chamber along a temperature gradient.

17. The method of claim 1 wherein the chamber is heated during the deposition process.

* * * * *

UNITED STATES PATENT AND TRADEMARK OFFICE

CERTIFICATE OF CORRECTION

PATENT NO. : 8,389,070 B2
APPLICATION NO. : 10/593207
DATED : March 5, 2013
INVENTOR(S) : Stephen Richard Coulson et al.

It is certified that error appears in the above-identified patent and that said Letters Patent is hereby corrected as shown below:

On the title page, item (73) Assignee

Delete "*The Secretary of State for Defence in Her Britannic Majesty's Government of the United Kingdom of Great Britain and Northern Ireland (GB)*"

Insert --P2i Ltd, Abingdon, Oxfordshire, United Kingdom (GB)--

Signed and Sealed this
Eighteenth Day of February, 2014

Michelle K. Lee

Michelle K. Lee
*Deputy Director of the United States Patent and Trademark Office*